US008421724B2

(12) United States Patent
Iwamoto et al.

(10) Patent No.: US 8,421,724 B2
(45) **Date of Patent: *Apr. 16, 2013**

(54) LIQUID CRYSTAL DISPLAY DEVICE

(75) Inventors: Akihisa Iwamoto, Matsusaka (JP); Hideki Morii, Matsusaka (JP); Kazushige Miyamoto, Matsusaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 96 days.

This patent is subject to a terminal disclaimer.

(21) Appl. No.: 12/586,448

(22) Filed: Sep. 22, 2009

(65) Prior Publication Data

US 2010/0097305 A1 Apr. 22, 2010

Related U.S. Application Data

(63) Continuation of application No. 10/289,832, filed on Nov. 7, 2002, now Pat. No. 7,612,750.

(30) Foreign Application Priority Data

Nov. 28, 2001 (JP) ..... 2001-362569

(51) Int. Cl.
*G09G 3/36* (2006.01)

(52) U.S. Cl.
USPC ..... 345/87; 345/93; 345/98

(58) Field of Classification Search ..... 345/87–100, 345/204
See application file for complete search history.

(56) References Cited

U.S. PATENT DOCUMENTS

| | | | |
|---|---|---|---|
| 5,268,764 | A | 12/1993 | Kihara et al. |
| 5,719,648 | A | 2/1998 | Yoshii et al. |
| 5,745,090 | A | 4/1998 | Kim et al. |
| 5,867,139 | A | 2/1999 | Tanaka et al. |
| 5,946,068 | A | 8/1999 | Lee et al. |
| 6,396,470 | B1 | 5/2002 | Zhang et al. |
| 6,812,908 | B2 | 11/2004 | Lim |
| 2002/0109652 | A1 | 8/2002 | Lim et al. |

FOREIGN PATENT DOCUMENTS

| | | |
|---|---|---|
| EP | 0 926 537 A2 | 6/1999 |
| JP | 01-180526 A | 7/1989 |
| JP | 04-251892 A | 9/1992 |

(Continued)

OTHER PUBLICATIONS

Office Action mailed Oct. 5, 2006 in parent U.S. Appl. No. 10/289,832.

(Continued)

*Primary Examiner* — Regina Liang
(74) *Attorney, Agent, or Firm* — Edwards Wildman Palmer LLP; George W. Neuner

(57) ABSTRACT

A liquid crystal display device includes: scanning wires, provided so as to correspond to a plurality of pixels disposed in a matrix manner, to which scanning signals are applied; and signal wires to which data signals are applied, wherein the scanning wires and the signal wires cross each other. TFTs, electrically connected to the scanning wires and the signal wires, each of which is provided in the vicinity of an intersection of the scanning wire and the signal wire, and the TFTs are connected to pixel electrodes. A dummy pixel driven by a dummy signal wire is provided externally adjacent to an endmost pixel column. This brings about a matrix type liquid crystal display device that equalizes capacitive conditions of all the signal wires to each other and can prevent deterioration of display quality that is brought about by a specific portion differently displayed.

1 Claim, 11 Drawing Sheets

FOREIGN PATENT DOCUMENTS

| | | | | |
|---|---|---|---|---|
| JP | 05-072557 | A | | 3/1993 |
| JP | 07-084239 | A | | 3/1995 |
| JP | 07-295522 | A | | 11/1995 |
| JP | 409033874 | | * | 2/1997 |
| JP | 09-090411 | A | | 4/1997 |
| JP | 09-179532 | A | | 7/1997 |
| JP | 10-186325 | A | | 7/1998 |
| JP | 10-213816 | A | | 8/1998 |
| JP | 11-52928 | | | 2/1999 |
| JP | 11-109404 | | | 4/1999 |
| JP | 2000-019560 | A | | 1/2000 |
| JP | 2001-066572 | A | | 3/2001 |
| KR | 1998-023919 | | | 7/1998 |
| KR | 2000-0062174 | | | 10/2000 |

OTHER PUBLICATIONS

Office Action mailed Mar. 14, 2007 in parent U.S. Appl. No. 10/289,832.

Office Action mailed Sep. 7, 2007 in parent U.S. Appl. No. 10/289,832.

Final Office Action mailed Jan. 15, 2008 in parent U.S. Appl. No. 10/289,832.

Advisory Action mailed Mar. 27, 2008 in parent U.S. Appl. No. 10/289,832.

Office Action mailed May 13, 2008 in parent U.S. Appl. No. 10/289,832.

Final Office Action mailed Oct. 21, 2008 in parent U.S. Appl. No. 10/289,832.

Advisory Action mailed Dec. 30, 2008 in parent U.S. Appl. No. 10/289,832.

Office Action mailed Feb. 3, 2009 in parent U.S. Appl. No. 10/289,832.

Notice of Allowance mailed Jun. 29, 2009 in parent U.S. Appl. No. 10/289,832.

* cited by examiner

FIG. 3 (a)

ODD-NUMBERED FIELD

| R | G | B | R | G | B | R | G | B | R |
|---|---|---|---|---|---|---|---|---|---|
| + | + | + | + | + | + | + | + | + | + |
| I | I | I | I | I | I | I | I | I | I |
| + | + | + | + | + | + | + | + | + | + |
| I | I | I | I | I | I | I | I | I | I |
| + | + | + | + | + | + | + | + | + | + |
| I | I | I | I | I | I | I | I | I | I |
| + | + | + | + | + | + | + | + | + | + |
| I | I | I | I | I | I | I | I | I | I |
| + | + | + | + | + | + | + | + | + | + |
| I | I | I | I | I | I | I | I | I | I |

FIG. 3 (b)

EVEN-NUMBERED FIELD

| R | G | B | R | G | B | R | G | B | R |
|---|---|---|---|---|---|---|---|---|---|
| I | I | I | I | I | I | I | I | I | I |
| + | + | + | + | + | + | + | + | + | + |
| I | I | I | I | I | I | I | I | I | I |
| + | + | + | + | + | + | + | + | + | + |
| I | I | I | I | I | I | I | I | I | I |
| + | + | + | + | + | + | + | + | + | + |
| I | I | I | I | I | I | I | I | I | I |
| + | + | + | + | + | + | + | + | + | + |
| I | I | I | I | I | I | I | I | I | I |
| + | + | + | + | + | + | + | + | + | + |

FIG. 4 (b)

EVEN-NUMBERED FIELD

| R | G | B | R | G | B | R | G | B | R |
|---|---|---|---|---|---|---|---|---|---|
| + | − | + | − | + | − | + | − | + | − |
| − | + | − | + | − | + | − | + | − | + |
| + | − | + | − | + | − | + | − | + | − |
| − | + | − | + | − | + | − | + | − | + |
| + | − | + | − | + | − | + | − | + | − |
| − | + | − | + | − | + | − | + | − | + |
| + | − | + | − | + | − | + | − | + | − |
| − | + | − | + | − | + | − | + | − | + |
| + | − | + | − | + | − | + | − | + | − |
| − | + | − | + | − | + | − | + | − | + |

FIG. 4 (a)

ODD-NUMBERED FIELD

| R | G | B | R | G | B | R | G | B | R |
|---|---|---|---|---|---|---|---|---|---|
| − | + | − | + | − | + | − | + | − | + |
| + | − | + | − | + | − | + | − | + | − |
| − | + | − | + | − | + | − | + | − | + |
| + | − | + | − | + | − | + | − | + | − |
| − | + | − | + | − | + | − | + | − | + |
| + | − | + | − | + | − | + | − | + | − |
| − | + | − | + | − | + | − | + | − | + |
| + | − | + | − | + | − | + | − | + | − |
| − | + | − | + | − | + | − | + | − | + |
| + | − | + | − | + | − | + | − | + | − |

LIQUID CRYSTAL DISPLAY DEVICE

This application is a continuation of U.S. application Ser. No. 10/289,832, filed Nov. 7, 2002 now U.S. Pat. No. 7,612,750, the teachings of which are incorporated herein by reference.

FIELD OF THE INVENTION

The present invention relates to an active matrix type liquid crystal display device constituted by disposing switching elements such as thin film transistors in a matrix manner.

BACKGROUND OF THE INVENTION

A liquid crystal display device is recently applied to various kinds of electric appliances as a thin and light flat panel display which can be driven at a low voltage and a low power, and the electric appliances are widely sold. As such liquid crystal display device, a matrix type liquid crystal display device is known.

The matrix type liquid crystal display device is such that an optical characteristic of liquid crystal is varied by applying driving voltages respectively applied to picture elements disposed in a matrix manner so as to display images and letters. Particularly, an active matrix driving mode enables high quality display such as high contrast and high speed response since it has a switching element such as a TFT (Thin Film Transistor) and a MIM (Metal Insulator Metal) in each picture element.

Here, description is given on an arrangement of the active matrix type liquid crystal display device using the TFT element.

The active matrix type display device includes a pair of upper and lower glass substrates, and liquid crystal is sealed therebetween. The one substrate is provided with the TFT element and a circuit wire connected to the TFT element.

That is, as shown in FIG. 9, on the substrate, there are provided scanning wires 81 (G1, G2, . . . ) from a scanning wire driving circuit 83 and signal wires 82 (S1, S2, . . . ) from a signal wire driving circuit 84 so that they are orthogonal to each other. In the vicinity of each of intersections of the scanning wires 81 (G1, G2, . . . ) and the signal wires 82 (S1, S2, . . . ), a TFT 85 is provided, and the TFT 85 is connected to a transparent pixel electrode 90.

Further, as shown in FIG. 10, a common electrode 92 is provided opposite to the pixel electrode 90, and the common electrode 92 is connected to a common wire (not shown). The pixel electrode 90 and the common electrode 92 constitute a capacitor for securing a crystal liquid capacitance Clc 91.

While, a gate electrode 87 of the TFT 85 is connected to each of the scanning wires 81 (G1, G2, . . . ), and a source electrode 88 of the TFT 85 is connected to each of the signal wires 82 (S1, S2, . . . ), and a drain electrode 89 of the TFT 85 is connected to the pixel electrode 90. Further, there is provided an auxiliary capacitance wire 86 below the pixel electrode 90. In order to realize the high image quality by improving retention of the liquid crystal, the pixel electrode 90 and the auxiliary capacitance wire 86 constitute a capacitor for securing auxiliary capacitance Cs 93.

In the arrangement, when the scanning wire driving circuit 83 inputs scanning signals to the scanning wires 81 (G1, G2, . . . ) sequentially, the input of the scanning signals allows gates of the TFTs 85 in one row to be ON simultaneously, and the signal wire driving circuit 84 inputs display data signals from the signal wires 82 (S1, S2, . . . ) to the respective pixels.

Thus, each of the data signals is applied to the pixel electrode 90, and a potential difference between the pixel electrode 90 and the common electrode 92 varies transmittance of the liquid crystal, so that letters and images are displayed on a liquid crystal panel. However, in this case, when a dc voltage is applied to the liquid crystal for a long time, a retaining property of the liquid crystal deteriorates. Thus, the polarity of the data signals inputted to the signal wires 82 (S1, S2, . . . ) is inverted at each horizontal period, for example, so as to perform so-called ac driving so that a positive voltage and a negative voltage are alternately applied to the pixel electrode 90.

Incidentally, in a case where conductive films are disposed in parallel or the conductive films are disposed up and down with an insulating film therebetween, it is general that there occurs parasitic capacitance therebetween. That is, an ideal condition of each pixel is such that, as shown in FIG. 10, there exist merely (a) the liquid crystal capacitance Clc 91 between the pixel electrode 90 and the common electrode 92 and (b) the auxiliary capacitance Cs between the pixel electrode 90 and the auxiliary capacitance wire 86.

Here, description is given by focusing on one pixel in the second row and in the second column shown in FIG. 9 for example, that is, a pixel in which the gate of the TFT 85 is connected to the scanning wire G2 positioned at the second stage from the top and the source of the TFT 85 is connected to the signal wire S2 positioned at the second stage from the left in FIG. 9.

As shown in FIG. 9, the pixel is such that the pixel electrode 90 is surrounded by the upper and lower scanning wires G2 and G3 and the left and right signal wires S2 and S3. Thus, as shown in FIG. 11, there occur the parasitic capacitance Cgd 94, Cgd 97, Csd 95, and Csd 96 between the pixel electrode 90 and the wires G2, G3, S2, and S3.

Further, in a case where the pixel electrode 90 is made to overlap the scanning wire 81 and/or the signal wire 82 with the insulating layer therebetween so as to increase an aperture ratio of the picture element, there occurs parasitic capacitance 98 between the pixel electrodes 90 adjacent to each other. Thus, a potential of the drain electrode 89 is influenced by the coupling of other capacitance and the parasitic capacitance brought about between the drain electrode 89 and the all the peripheral wires.

However, the conventional liquid crystal display device brings about the following problems.

That is, the foregoing description on the case where the parasitic capacitance occurs in each pixel is to illustrate one pixel in which the TFT 85 is connected to the signal wire S2 at the second stage from the right. When description is given by focusing on one pixel in which the TFT 85 is connected to the leftmost signal wire S1, the pixel electrode 90 does not exist leftward with respect to the pixel electrode 90 constituting the pixel, so that the parasitic capacitance 98 does not occur between the pixel electrode 90 and the left pixel electrode 90.

Further, when the signal wire S1 is focused on, no pixel exists leftward with respect to the signal wire S1, so that there is no parasitic capacitance Csd 96 between the signal wire S1 and the left pixel electrode 90. Merely the parasitic capacitance Csd 95 exists between the pixel electrodes 90 adjacent to each other, so that wire capacitance in the signal wire S1 is smaller than that of the signal wires S2 and S3 centrally disposed.

Thus, the leftmost signal wire S1 is different from the signal wires S2, S3, . . . that are centrally positioned, and they are different from each other in the coupling capacitance of the wiring and the pixels. Thus, under the same driving condition as in the signal wires S2, S3, . . . , the drain electrode 89 of the pixel in the signal wire S1 has a potential different from that of the pixels centrally disposed.

Thus, even when the same voltages are to be applied to all the pixels of the entire screen, a different voltage is applied to the liquid crystal of the left-end pixel unlike the pixels centrally positioned, so that there occurs such a problem that the leftmost pixel is seemingly colored when a gray image is displayed.

Note that, the foregoing description is on the leftmost signal wire S1, and the rightmost signal wire Sn bears the same problem since the capacitive condition is different from that of the central lines.

Note that, as a solution for this problem, Japanese Unexamined Patent Publication No. 84239/1995 (Tokukaihei 7-84239) (Publication date: Mar. 31, 1995) discloses a liquid crystal display device. In this technique, a dummy signal wire is provided adjacent to the signal wire, but the following problem remains to be solved. In a case where the pixel electrode is made to overlap the scanning wire and/or the signal wire with the insulating layer therebetween so as to increase an aperture ratio of the picture element, the parasitic capacitance between the pixel electrodes adjacent to each other exerts bad influences.

SUMMARY OF THE INVENTION

The object of the present invention is to provide a matrix type liquid crystal display device that equalizes capacitive conditions of all the signal wires and/or all the pixels and can prevent deterioration of display quality that is brought about by a specific portion differently displayed. In order to achieve the foregoing object, the liquid crystal display device of the present invention includes: scanning wires, provided corresponding to a plurality of pixels disposed in a matrix manner, to which scanning signals are applied; signal wires, provided corresponding to the pixels so as to cross the scanning wires, to which data signals are applied; switching elements, electrically connected to the scanning wires and the signal wires, each of which is provided in a vicinity of each of intersections of the scanning wires and the signal wires; pixel electrodes connected to the switching elements; and a dummy pixel, provided externally adjacent to an endmost pixel column, that is driven by a dummy signal wire.

According to the arrangement, the dummy pixel driven by the dummy signal wire is provided externally adjacent to the endmost pixel column, so that it is possible to drive the pixel on the endmost signal wire under the same condition as in central pixels. That is, the dummy pixel is provided externally adjacent to the endmost pixel, so that in the endmost pixel, a condition of parasitic capacitance brought about between (a) the pixel electrode and (b) the signal wire/the scanning wire, and a condition of parasitic capacitance brought about between the pixel electrodes adjacent to each other are the same as the corresponding conditions of the pixels centrally disposed.

Therefore, a potential of a drain electrode in the endmost pixel is applied under the same condition as in a potential of a drain electrode in the central pixel. Thus, it is possible to reduce problems such as coloring in a gray image, so that high display quality can be secured. Particularly in a structure in which the pixel electrode is made to overlap the scanning wire and the signal wire with an insulating film layer therebetween so as to increase an aperture ratio of the picture element, the parasitic capacitance between pixel electrodes adjacent to each other is large, so that the foregoing arrangement is particularly effective.

As a result, it is possible to provide a matrix type liquid crystal display device that equalizes capacitive conditions of all the signal wires and pixels to each other and can prevent deterioration of display quality that is brought about by a specific portion differently displayed.

In order to achieve the foregoing object, the liquid crystal display device of the present invention includes: scanning wires, provided corresponding to a plurality of pixels disposed in a matrix manner, to which scanning signals are applied; signal wires, provided corresponding to the pixels so as to cross the scanning wires, to which data signal are applied; switching elements, electrically connected to the scanning wires and the signal wires, each of which is provided in a vicinity of each of intersections of the scanning wires and the signal wires; and a dummy signal wire provided externally adjacent to an endmost pixel column, wherein the dummy signal wires are connected to an output buffer.

According to the arrangement, the output buffer is connected to the dummy signal wire, so that it is possible to equalize a condition of the dummy signal wire to a condition of the signal wire so as to drive the dummy signal wire under the same condition as in the signal wire.

As a result, it is possible to provide a matrix type liquid crystal display device that equalizes capacitive conditions of all the signal wires to each other and can prevent deterioration of display quality that is brought about by a specific portion differently displayed.

For a fuller understanding of the nature and advantages of the invention, reference should be made to the ensuing detailed description taken in conjunction with the accompanying drawings.

BRIEF DESCRIPTION OF THE DRAWINGS

FIG. 3(*a*) is a diagram showing an odd numbered field in a case where the liquid crystal display device is driven in accordance with a gate line inversion driving mode.

FIG. 3(*b*) is a diagram showing an even numbered field in the case where the liquid crystal display device is driven in accordance with the gate line inversion driving mode.

FIG. 4(*a*) is a diagram showing an odd numbered field in a case where the liquid crystal display device is driven in accordance with a dot inversion driving mode.

FIG. 4(*b*) is a diagram showing an even numbered field in the case where the liquid crystal display device is driven in accordance with the dot inversion driving mode.

DESCRIPTION OF THE EMBODIMENTS

[Embodiment 1]

One embodiment of the present invention is described as follows based on FIG. 1 through FIG. 5.

A liquid crystal display device of the present embodiment is an active matrix type liquid crystal display device using a TFT (Thin Film Transistor) element. However, an arrangement of the liquid crystal display device is not necessarily limited to this, but the liquid crystal display device can be arranged so as to have a switching element such as an MIM (Metal Insulator Metal).

Figure 1:
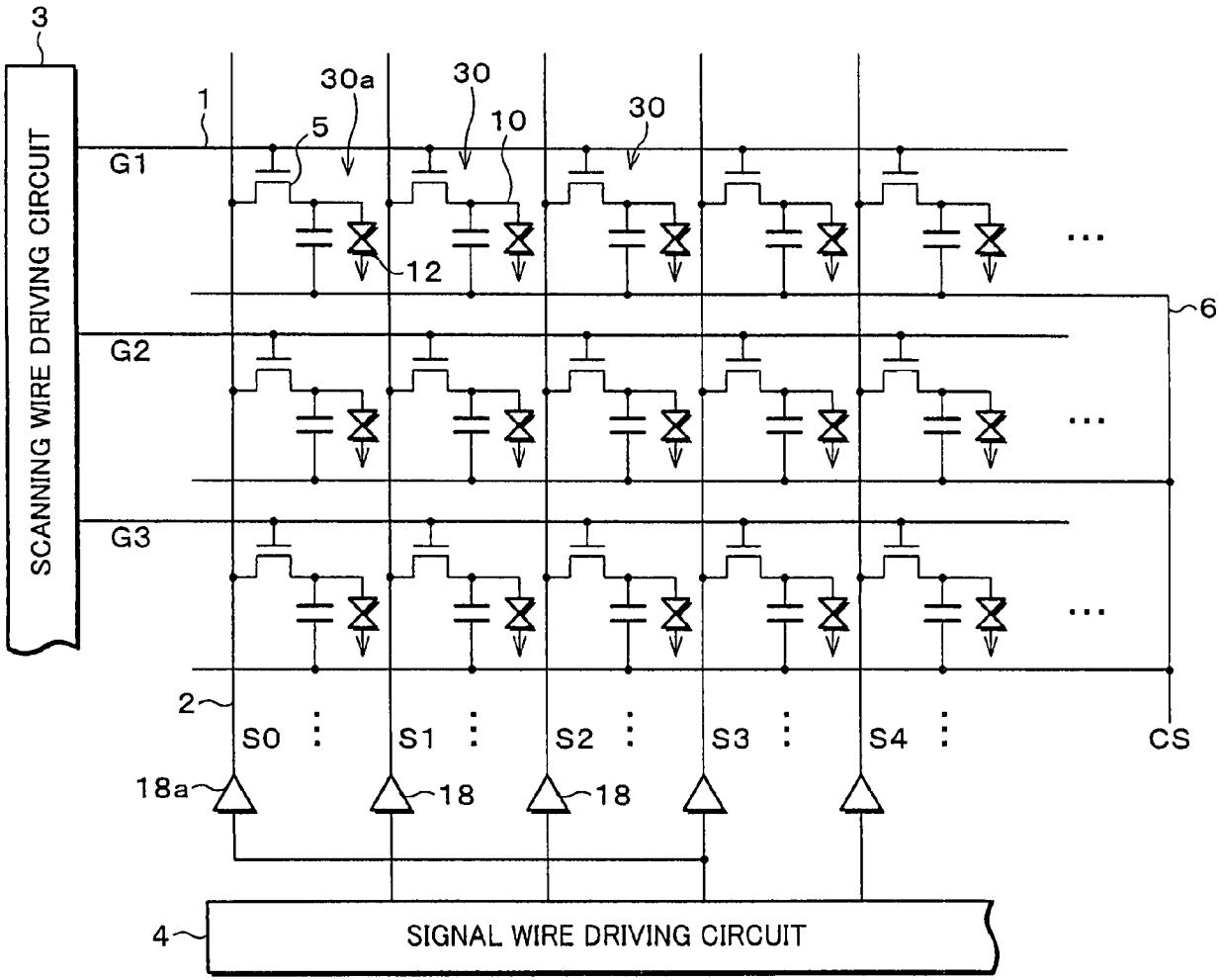
FIG. 1 is a diagram showing one embodiment of a liquid crystal display device of the present invention.

As shown in FIG. 1, the foregoing active matrix type liquid crystal display device includes: a pair of upper and lower transparent glass substrates (not shown) so that liquid crystal is sealed therebetween; and a plurality of pixels 30 . . . provided in a matrix manner.

There is provided a TFT element and a circuit wire connected to the TFT element on the one glass substrate.

Concretely, as shown in FIG. 1, on the substrate, there are provided (a) scanning wires 1 (G1, G2, . . . ) to which scanning signals provided from a scanning wire driving circuit 3 are sequentially applied and (b) signal wires 2 (S1, S2, . . . ) to which data signals provided from a signal wire driving circuit 4 are sequentially applied, and both the wires are disposed in an orthogonal manner. In the vicinity of each of intersections of the scanning wires 1 (G1, G2, . . . ) and the signal wires 2 (S1, S2, . . . ), a TFT 5 is provided as a switching element, and the TFT 5 is connected to a transparent pixel electrode 10.

Figure 2:
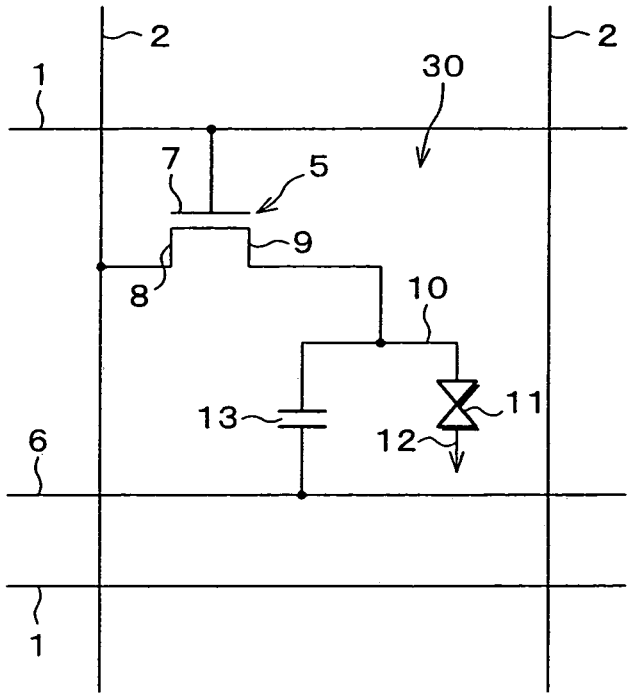
FIG. 2 is an equivalent circuit diagram showing one pixel of the liquid crystal display device.

As shown in FIG. 2, there are provided (a) a common electrode 12 made of a transparent conductive film and (b) a color filter (not shown) both of which are opposite to the pixel electrode 10, and the common electrode 12 is connected to a common wire (not shown) to which a common signal is applied. Further, the pixel electrode 10 and the common electrode 12 constitute a capacitor for securing liquid crystal capacitance Clc 11 as liquid crystal. Further, the color filter contains three primary colors: R (Red), G (Green), and B (Blue), and they correspond to the respective pixel electrodes 10 . . . . Further, a deflecting plate (not shown) is externally provided on each glass substrate.

While, a gate electrode 7 of the TFT 5 is connected to each of the scanning wires 1 (G1, G2, . . . ), and a source electrode 8 of the TFT 5 is connected to each of the signal wires 2 (S1, S2, . . . ), and a drain electrode 9 of the TFT 5 is connected to the pixel electrode 10. Further, there is provided an auxiliary capacitance wire 6 below the pixel electrode 10. In order to realize the high image quality by improving retention of the liquid crystal, the pixel electrode and the auxiliary capacitance wire 6 constitute a capacitor for securing auxiliary capacitance Cs 13.

In the arrangement, when the scanning wire driving circuit 3 sequentially inputs scanning signals to the scanning wires 1 (G1, G2, . . . ) downward as shown in FIG. 1, the input of the scanning signals allows gates of the TFTs 5 . . . in a certain row to be ON simultaneously, and the signal wire driving circuit 4 inputs display data signals via the signal wires 2 (S1, S2, . . . ) to the respective pixels 30.

Thus, each of the data signals is applied to the pixel electrode 10, and a potential difference between the pixel electrode 10 and the common electrode 12 varies transmittance of the liquid crystal, so that letters and images are displayed on a liquid crystal panel. However, when a dc voltage is applied to the liquid crystal for a long time, a retaining property of the liquid crystal deteriorates. Thus, the polarity of the data signals inputted to the signal wires 2 (S1, S2, . . . ) is inverted at each horizontal period for example, so as to perform so-called ac driving so that a positive voltage and a negative voltage are alternately applied to the pixel electrode 10.

Here, the aforementioned gate line inversion driving mode is described in detail. Note that, although the following description is on a gate line inversion driving mode in which inversion is performed at each gate line, the present invention is not necessarily limited to the inversion performed at each gate line, and is applicable to a gate line inversion driving mode in which inversion is performed at intervals of plural lines such as intervals of two lines.

The reason for which the liquid crystal is ac driven is as described above. There are various modes to perform the ac driving, and the gate line inversion driving mode is one of the most-often-employed modes in these modes.

First, a plus voltage and minus voltage are alternately applied to the liquid crystal so as to perform the ac driving. As shown in FIG. 3(*a*), the polarity is inverted at intervals of one horizontal line in the gate line inversion driving mode. Further, as shown in FIG. 3(*b*), at the next field, the polarity is entirely inverted. The gate line inversion driving mode brings about an advantage that: a cycle of the inversion is shorter compared with a conventional 1 vertical line inversion driving mode, so that flicker is hardly seen.

In addition to the foregoing arrangement, the liquid crystal display device of the present embodiment further includes the following characteristics.

That is, as shown in FIG. 1, the liquid crystal display device of the present embodiment includes a dummy pixel 30*a* and a dummy signal wire S0 outside the left signal wire S1. The leftmost dummy signal wire S0 is driven upon 1 horizontal line inversion driving under the same driving condition as in the central signal wires S1, S2, . . . . Concretely, a signal outputted from the signal wire driving circuit 4 is outputted via a dummy signal wire output buffer 18*a*' to the dummy signal wire S0.

Here, in a case where a uniformed color tone is displayed on an entire screen, a data signal of the signal wire S1 and a data signal of the signal wire S4 are identical to each other in terms of color and polarity. Thus, it is necessary to apply a voltage to the pixels 30 . . . on the signal wire S1 so that the pixels 30 . . . on the signal wire S4 are equalized with the pixels 30 . . . on the signal wire S1 in terms of a voltage. Further, it is necessary to drive the signal wire S1 under the same driving condition (capacitance condition) as in the signal wire S4 so as to apply the voltage to the pixels 30 . . . the signal wire S1 so that both the pixels are equalized with each other in terms of a voltage.

In terms of this condition, it is necessary to input the same data signal as that of the signal wire S3 to the dummy signal wire S0 leftward adjacent to the signal wire S1. Thus, the dummy signal wire S0 is connected to the signal wire S3 three lines following the dummy signal wire S0 via the dummy signal wire output buffer 18*a*'. Note that, although the dummy signal wire S0 is connected to the signal wire S3 three lines following the dummy signal wire S0 in the foregoing example, the arrangement is not necessarily limited to this, but the following arrangement is possible: each of the signal wires 2 (S1, S2, . . . ) leading a signal of the same color and the same polarity appears at intervals of 3n (n=1, 2, . . . ) lines, so that the dummy signal wire S0 can be connected to the signal wire 2 (S1, S2, . . . ) that is a 3n (n=1, 2, . . . )th line from the dummy signal wire S0.

As a result, the data signal of the signal wire S3 is inputted to the dummy signal wire output buffer 18*a*', so that the dummy signal wire S0 is driven by the same applied voltage as in the signal wire S3. Here, an input signal of the dummy signal wire output buffer 18*a*' may be taken in via an output section or an input section of the corresponding signal wire output buffer.

Thus, the influence caused in the conventional leftmost signal wire S1 by the capacitive coupling of (a) the signal wire S1 and (b) the adjacent dummy pixel 30*a*/the dummy signal wire S0 is equalized to the influence caused in the signal wire S4 by the capacitive coupling of (a) the signal wire S4 leading a signal of the same color and polarity and (b) the adjacent pixel 30/the signal wire S3. Thus, the problem that a pixel is colored in a gray image is solved.

Note that, although the example of how the gate line inversion driving mode is applied is shown in the foregoing description, the arrangement is not necessarily limited to this, and the following arrangement is possible: the endmost signal wire can be driven in the same manner as in the central signal wires in accordance with a dot inversion driving mode or a source inversion driving mode. In the gate line inversion driving, the polarity is inverted at intervals of a horizontal line. In addition to such inversion, as shown in FIG. 4(*a*) and FIG. 4(*b*), the polarity is inverted at intervals of one vertical line adjacent to another vertical line in the dot inversion driving mode.

Further, as shown in FIG. 4(*a*) and FIG. 4(*b*), a certain vertical line and a vertical line that is the 6th line from the certain vertical line lead signals of the same color and polarity in the dot inversion driving mode.

Note that, the dummy signal wire S0 is connected to the signal wire S6 that is 6th line from the dummy signal wire S0 in the foregoing example, the arrangement is not necessarily limited to this, and the following arrangement is possible: since the signal wire 2 (S1, S2, . . . ) leading a signal of the same color and polarity appears at intervals of 6n (n=1, 2, . . . ) lines, the signal wire 2 can be connected to another signal wire 2 (S1, S2, . . . ) that is a 6n (n=1, 2, . . . )th line therefrom. Further, since an operation as in the dot inversion driving mode is performed with respect to each of the scanning wires 1 (G1, G2, . . . ) also in the source inversion driving mode, it is possible to perform the connection as in the dot inversion driving mode.

Figure 5:
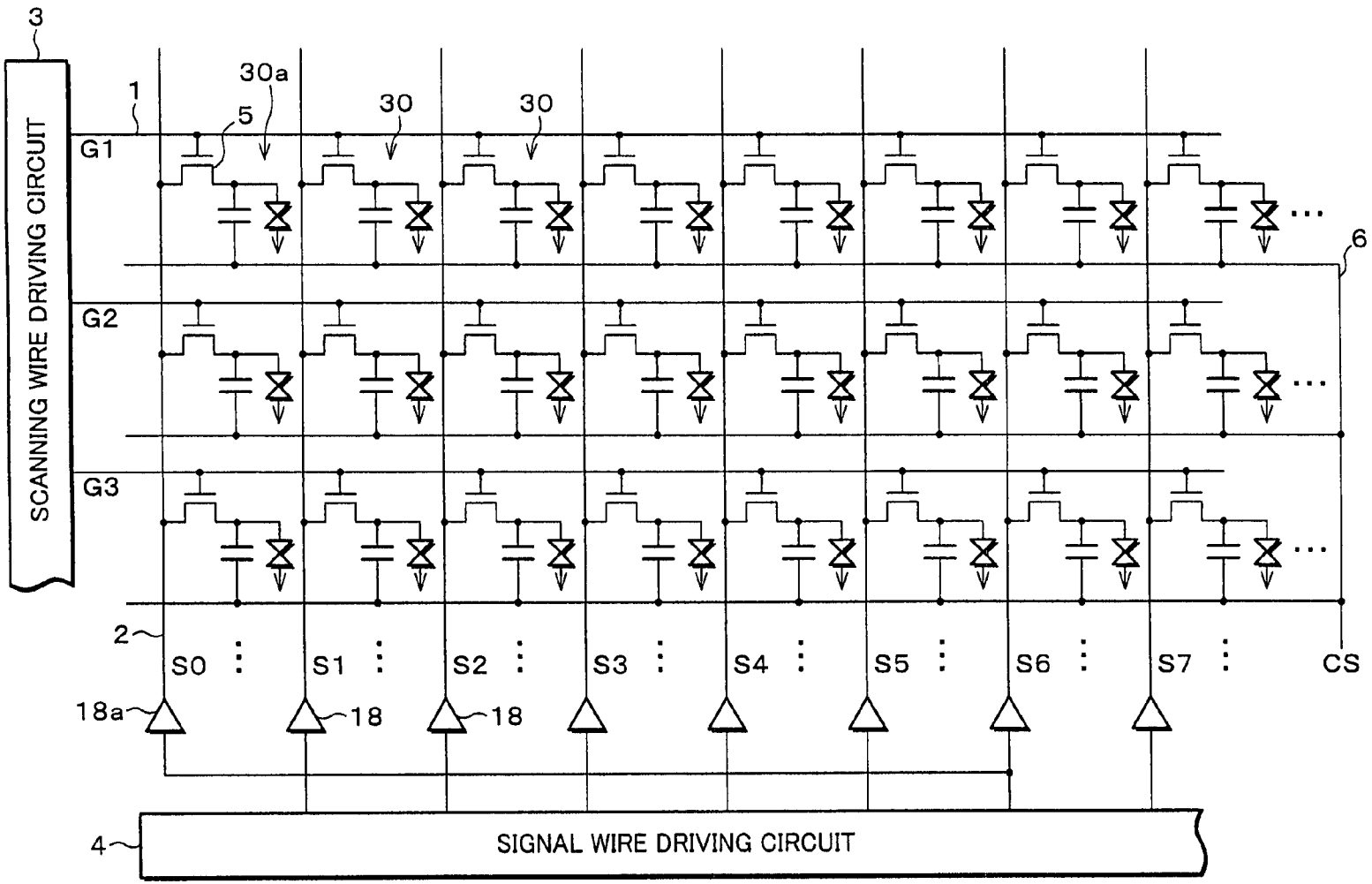
FIG. 5 is a diagram showing a connection process of a dummy signal wire in a case where the liquid crystal display device is driven in accordance with the dot inversion driving mode.

Thus, as shown in FIG. 5, a signal of the signal wire S6 is inputted via the dummy signal wire output buffer 18*a*' to the dummy signal wire S0, so that the conventional leftmost signal wire S1 can be driven under the same condition as in the central signal wire 7. Thus, as in the gate line inversion driving mode, it is possible to solve the problem that a pixel is differently colored.

Further, the foregoing process is applicable to the source inversion driving mode. That is, the polarity is inverted at each signal wire 2 (S1, S2, . . . ) in the source inversion driving mode. Thus, the signal wire 2 (S1, S2, . . . ) leading a signal of the same color and polarity appears at intervals of 6n (n=1, 2, . . . ) lines, so that the signal wire 2 can be connected to another signal wire 2 (S1, S2, . . . ) that is a 6n (n=1, 2, . . . )th line therefrom.

Note that, since the dummy pixel 30*a* is provided in the present embodiment, a problem is that the display quality may be influenced by the dummy pixel 30*a*. In the present embodiment, a voltage is applied to liquid crystal of the dummy pixel 30*a* as in an ordinary pixel 30, but the dummy pixel 30*a* is covered by a black matrix for example so that the display is invisible. Thus, the display quality is not influenced by the dummy pixel 30*a*.

As described above, in the liquid crystal display device of the present invention, the dummy pixels 30*a* . . . driven by the dummy signal wire S0 are provided outside the leftmost pixels 30 . . . , so that it is possible to drive the pixels 30 . . . on the leftmost signal wire S1 under the same condition as in the central pixels 30 . . . . That is, since the dummy pixels 30*a* . . . are provided outside the leftmost pixels 30 . . . , a condition of the parasitic capacitance brought about between (a) the pixel electrode 10 and (b) the dummy signal wires S0/the scanning wires 1 (G1, G2, . . . ), and a condition of the parasitic capacitance brought about between the pixel electrodes 10 . . . adjacent to each other are equalized to corresponding conditions of the pixels 30 . . . that are centrally disposed.

Thus, a potential of the drain electrode of the conventional leftmost pixels 30 . . . and a potential of the drain electrode of each of the centrally disposed pixels 30 . . . are applied under the same condition. Thus, it is possible to reduce phenomenon such as coloring in a gray image, and it is possible to secure the high display quality.

Recently, there is provided a liquid crystal display device in which the pixel electrodes 10 . . . are made to overlap the scanning wires 1 (G1, G2, . . . ) and the signal wires 2 (S1, S2, . . . ) with the insulating film layer provided therebetween so as to increase an aperture ratio of the picture element. In this case, the parasitic capacitance brought about between the pixel electrodes 10 . . . adjacent to each other has a great influence and deteriorates the display quality, so that it is greatly effective to apply the arrangement of the liquid crystal display device of the present embodiment to the foregoing structure.

As a result, it is possible to provide such a matrix type liquid crystal display device that: capacitance conditions of all the signal wires 2 (S1, S2, . . . ) and the pixels 30 . . . can be equalized to each other, and it is possible to prevent the deterioration of the display quality caused by differently displayed portions.

Further, in the liquid crystal display device of the present embodiment, the dummy signal wire S0 is connected to the dummy pixel driving output buffer 18*a*. That is, it is typical that the signal wires 2 (S1, S2, . . . ) are respectively connected to the output buffers 18 . . . . Thus, in order to drive the dummy signal wire S0 under the same condition as in the signal wires 2 (S1, S2, . . . ), it is necessary to provide the output buffers 18 . . . on the dummy signal wire S0.

According to the present embodiment, the dummy signal wire S0 is connected to the dummy pixel driving output buffer 18*a*, so that it is possible equalize a condition of the dummy signal wire S0 to a condition of the signal wires 2 (S1, S2, . . . ) so as to drive the dummy signal wire S0 under the same condition as in the signal wires S2 (S1, S2, . . . ).

Further, in the liquid crystal display device of the present embodiment, the dummy signal wire S0 connected to the dummy pixel 30*a* is connected to corresponding one of the data signal wires 2 (S1, S2, . . . ) leading a signal of the same color and polarity, in accordance with a cycle at which specific combination of color and polarity in the ac driving appears.

That is, in the liquid crystal display device, when a dc voltage is applied to the liquid crystal for a long time, a retaining property of the liquid crystal is deteriorated. Thus, the ac driving in which the polarity of a data signal inputted to the signal wires 2 (S1, S2, . . . ) is alternately inverted is employed. Examples of the ac driving mode include a gate line inversion driving mode, a dot inversion driving mode, or a source inversion driving mode. They are different from each other in that a cycle at which the signal wires 2 (S1, S2, . . . ) for supplying data signals of the same color and polarity are disposed.

However, in the present embodiment, the dummy signal wire S0 is connected to corresponding one of the signal wires 2 (S1, S2, . . . ) leading a data signal of the same color and polarity, in accordance with a cycle at which specific combination of color and polarity in the ac driving appears. Thus, the influence caused in the endmost signal wire S1 by the capacitive coupling of (a) the signal wire S1 and (b) the adjacent pixel/wire is equalized to the influence caused in the signal wire S4 or the signal wire S7 leading a signal of the same color and polarity as the endmost signal wire S1, so that the problem such as coloring in a gray image is solved.

Further, in the liquid crystal display device of the present embodiment, in the case of the gate line inversion driving mode, the dummy signal wire S0 connected to the dummy pixel 30*a* is connected to a signal wire 2 that is a 3n (n=1, 2, . . . )th line from the dummy signal wire S0.

That is, in the gate line inversion driving mode of the ac driving mode, a voltage of the same polarity and color is applied at intervals of three signal wires 2. Thus, in order to equalize the driving condition of the dummy signal wire S0 and the signal wire S1 on the endmost pixel 30 to the driving condition of the central pixels 30 . . . , the dummy signal wire S0 is made capable of obtaining the same data signal as in a signal wire 2 that is a 3n (n=1, 2, . . . )th line from the dummy signal wire S0.

According to the present embodiment, in the case of the gate line inversion driving mode, the dummy signal wire S0 is connected to a signal wire 2 that is a 3n (n=1, 2, . . . )th line from the dummy signal wire S0. Thus, the dummy signal wire S0 can obtain the same data signal as in signal wires S3, S6, . . . disposed at intervals of 3n (n=1, 2, . . . ) lines, so that the influence caused in the endmost signal wire S1 by the capacitive coupling of (a) the signal wire S1 and (b) the adjacent pixel/wire is equalized to the influence caused in the signal wires S4, S7 . . . , leading a signal of the same color and polarity, each of which is 3n (n=1, 2, . . . )th line from the dummy signal wire S0. Thus, the problem such as coloring in a gray image is solved.

Further, in the liquid crystal display device of the present embodiment, the dummy signal wire S0 connected to the dummy pixel 30*a* is connected to the signal wires 2 (S1, S2, . . . ) each of which is a 6n (n=1, 2, . . . )th line from the dummy signal wire S0 in the case of the dot inversion driving mode or the source inversion mode.

That is, in the gate line inversion driving mode, the polarity is inverted at intervals of one horizontal line. In addition to this, the polarity is inverted at intervals of one vertical line adjacent to another vertical line in the dot inversion driving mode of the ac driving mode. Further, in the source inversion driving mode, the polarity is inverted at intervals of one signal wire. Thus, in the dot inversion driving mode or the source inversion driving mode, a voltage of the same color and polarity is applied at intervals of the signal line 2 in which the one is a 6n (n=1, 2, . . . )th line from the other. Therefore, in order to equalize the driving condition of the dummy signal wire S0 and the signal wire S1 on the endmost pixels 30 to the driving condition of the central pixels 30 . . . , the dummy signal wire S0 is made capable of obtaining the same data signal as in the signal wire 2 that is a 6n (n=1, 2, . . . )th line from the dummy signal wire S0.

According to the present embodiment, in the case of the dot inversion driving mode or the source inversion driving mode, the dummy signal wire S0 is connected to the signal wires S6, S12 . . . that are disposed at intervals of 6n (n=1, 2, . . . ) lines from the dummy signal wire S0. Thus, the dummy signal wire S0 can obtain the same data signal as in the signal wires S6, S12, . . . that are disposed at intervals of 6n (n=1, 2, . . . ) lines from the dummy signal wire S0, so that the influence caused by the capacitive coupling of the adjacent pixels and wires is equalized to the foregoing influence of the endmost signal wire S1 as in the signal wires S6, S12, . . . , leading a signal of the same polarity, that are disposed at intervals of 6n (n=1, 2, . . . ) lines from the dummy signal wire S0. Thus, the problem such as coloring in a gray image is solved.

Note that, although action and effect brought about by combination of the dummy pixel 30*a* and the dummy signal wires S0 are described in the present embodiment, the arrangement of the present invention is not limited to this, and also in a case where only the dummy signal wire S0 is provided, it is possible to provide such a matrix type liquid crystal display device that: capacitance conditions of all the signal wires can be equalized to each other, and it is possible to prevent the deterioration of the display quality caused by differently displayed portions.

[Embodiment 2]

Another embodiment of the present invention is described as follows based on FIG. 6 through FIG. 8. Note that, the same reference signs are given to members having the same functions as the members shown in Embodiment 1 and the corresponding drawings, and description thereof is omitted for convenience.

In the present embodiment, description is given on a case where a spare wire for restoring a disconnected signal wire is used also as the dummy signal wire S0.

Figure 6:
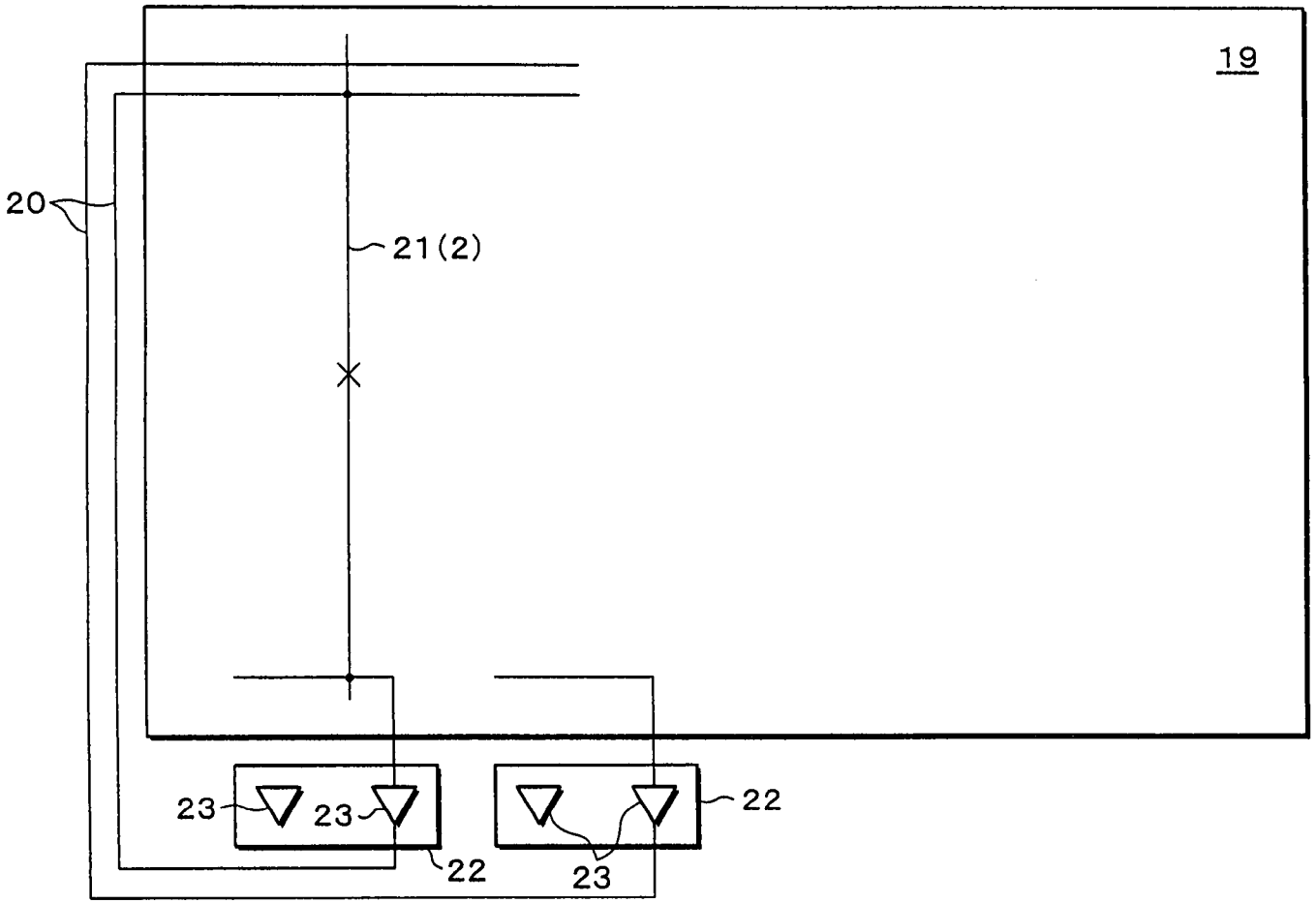
FIG. 6 shows another embodiment of the liquid crystal display device of the present invention, and is a diagram showing how a disconnected signal wire is restored by using a spare wire provided in the periphery of a liquid crystal panel.

As shown in FIG. 6, the signal wires 2 (S1, S2, . . . ) are sometimes disconnected due to failed film formation upon manufacturing the liquid crystal display device. Then, in the liquid crystal display device of the present embodiment, in order to restore the disconnection, there are provided two spare wire driving output buffers 23 on each of source drivers 22 . . . , and the spare wire driving output buffer 23 on the right side in FIG. 6 is connected to spare wires 20 . . . that extend along a periphery portion of a liquid crystal panel 19. Note that, a line connected to the spare wire 20 is heavy-loaded, so that a driving property thereof is insufficient. Thus, in the present embodiment, the spare wire driving output buffer 23 is provided in the source driver 22. Further, in the present embodiment, the source driver 22 is provided in each of plural pixels 30 . . . .

Here, it is assumed that the signal wire 21 is a disconnected signal wire. When the signal wire 21 is disconnected, a data signal cannot be sent to portions on the downstream side with respect to the disconnected point, so that the signal wire 21 is seemingly a bright line. Thus, the liquid crystal panel is regarded as a defective panel.

Then, the spare wire 20 that extends along the peripheral portion of the liquid crystal panel 19 is connected to both ends of the disconnected signal wire 21, so that it is possible to send the data signal outputted to the signal wire 21 to the portions on the downstream side with respect to the disconnected point. As a result, it is possible to create ordinary line display at a portion of the bright line, thus clearing the defect.

Here, in the present embodiment, the spare wire driving output buffer 23 is used also as the dummy pixel driving output buffer 18*a* as described above.

Figure 7:
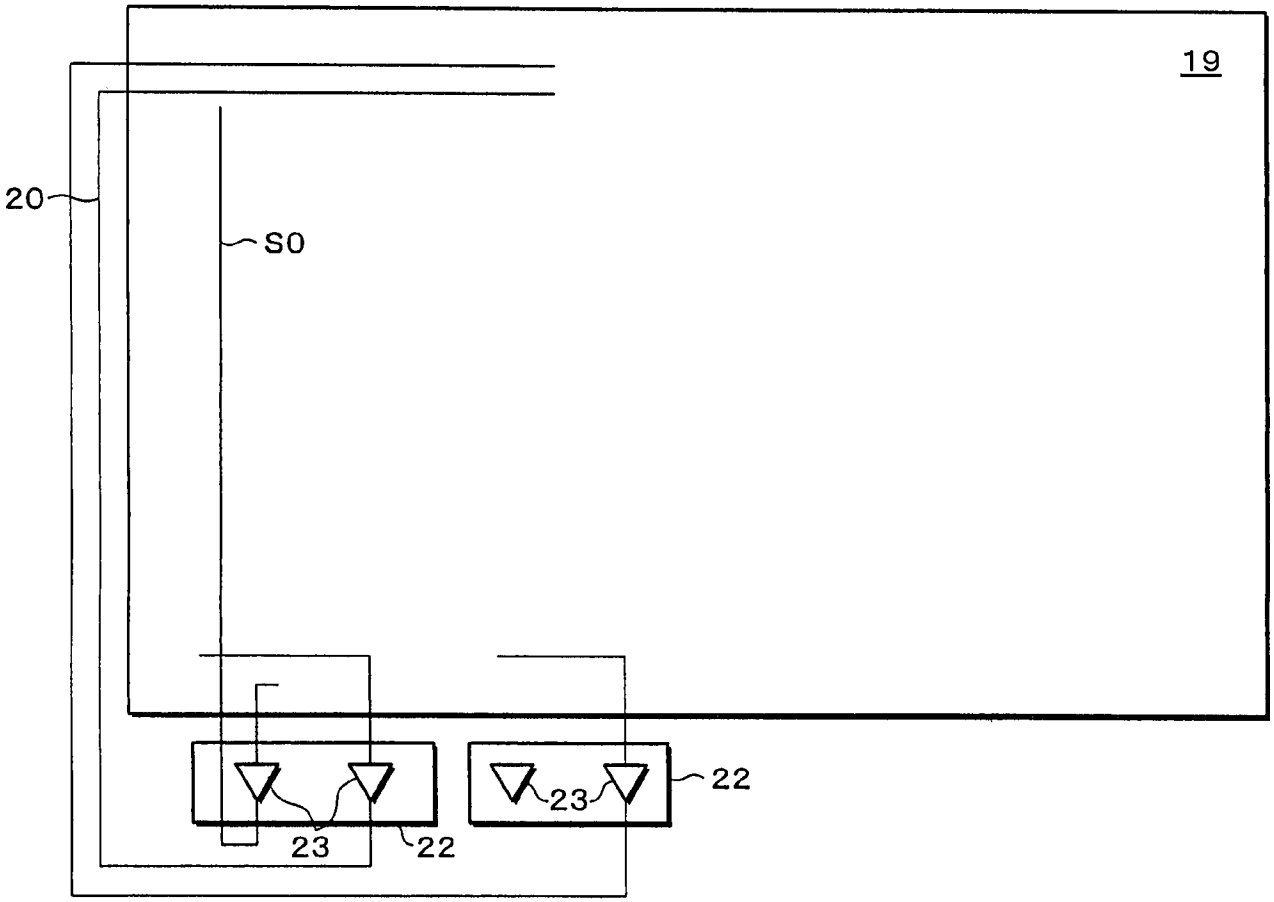
FIG. 7 is a diagram showing how the dummy signal wire is connected to a spare wire driving output buffer on the left side of a source driver on the left end of the liquid crystal display device.
Figure 8:
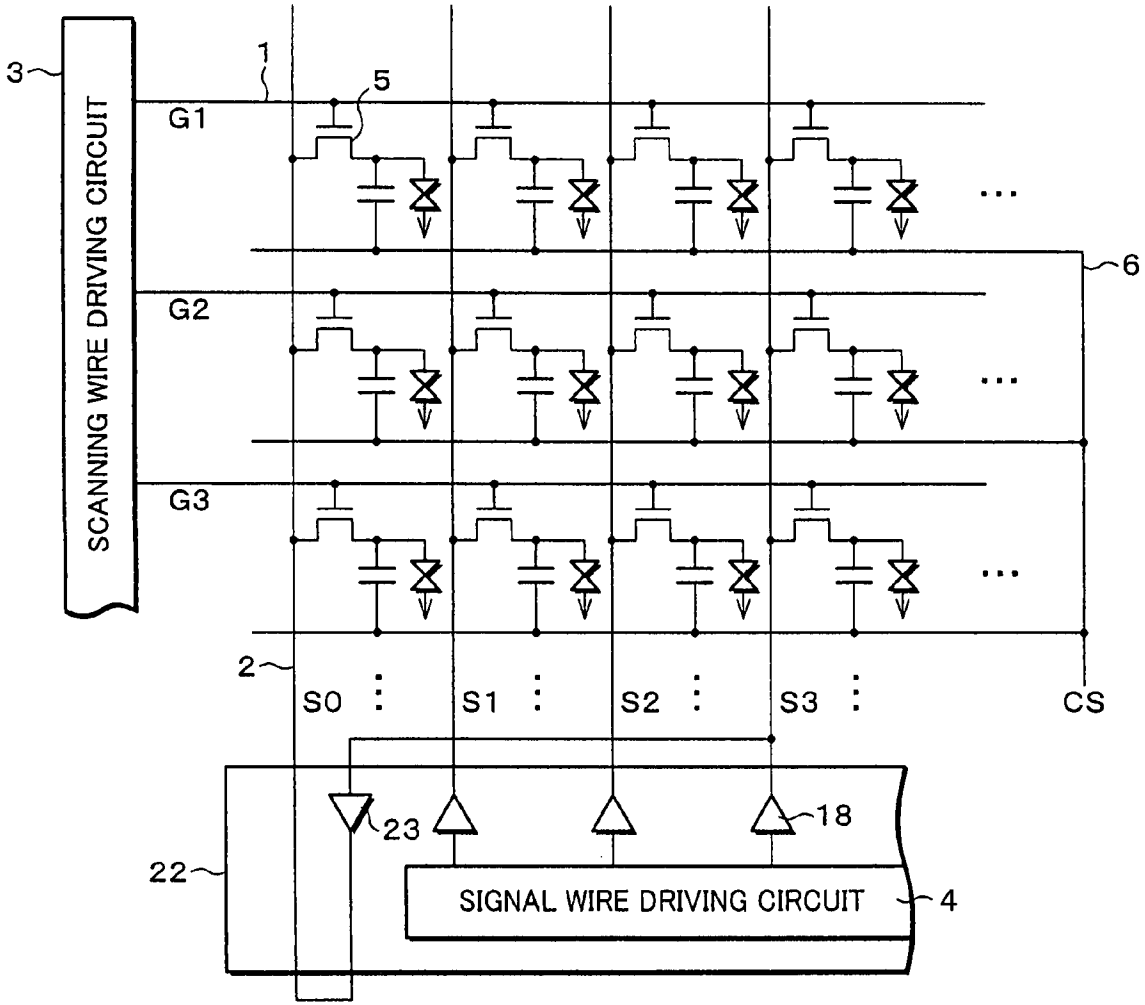
FIG. 8 is a diagram showing how the spare wire driving output buffer of the liquid crystal display device is used also as a dummy pixel driving output buffer.
Figure 9:
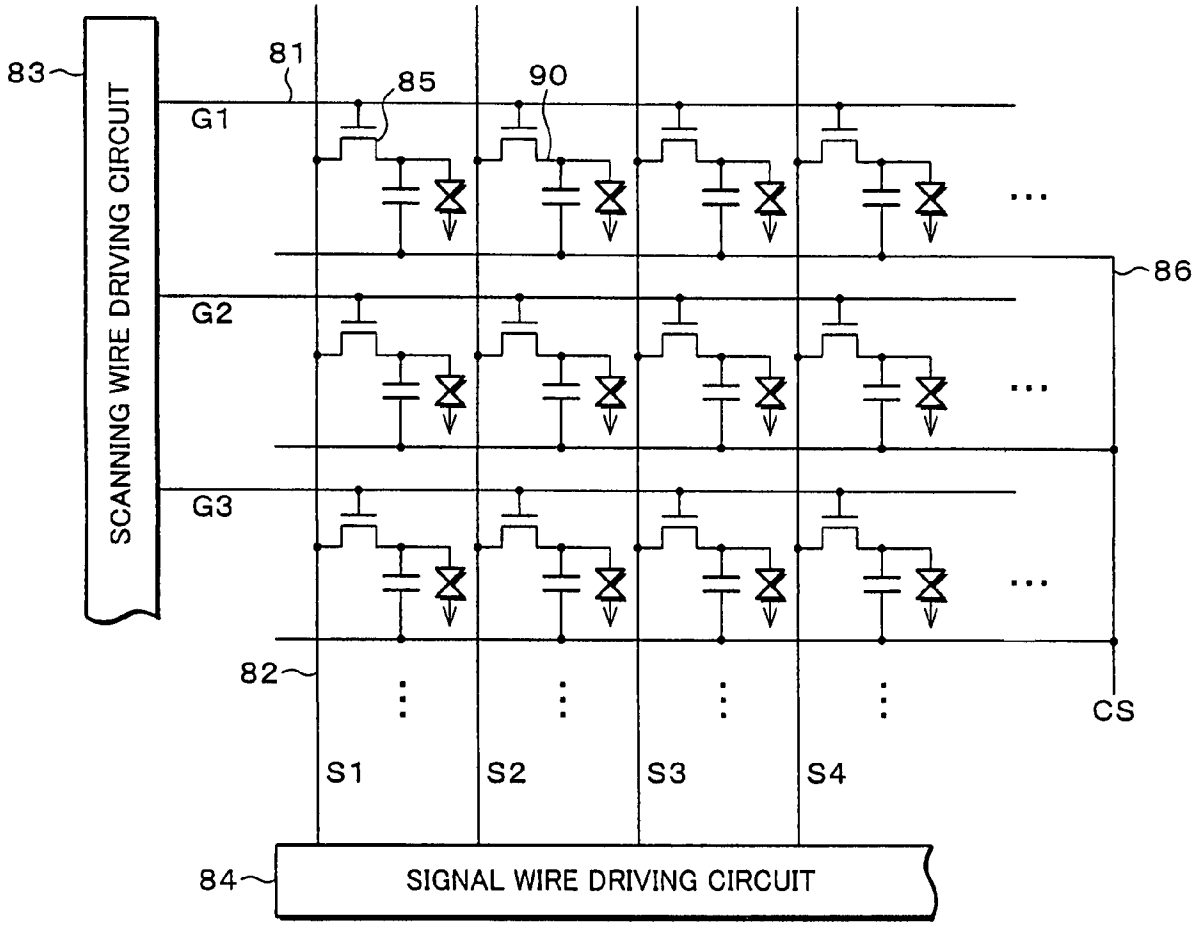
FIG. 9 (PRIOR ART)
FIG. 9 is a diagram showing a conventional active matrix type liquid crystal display device.
Figure 10:
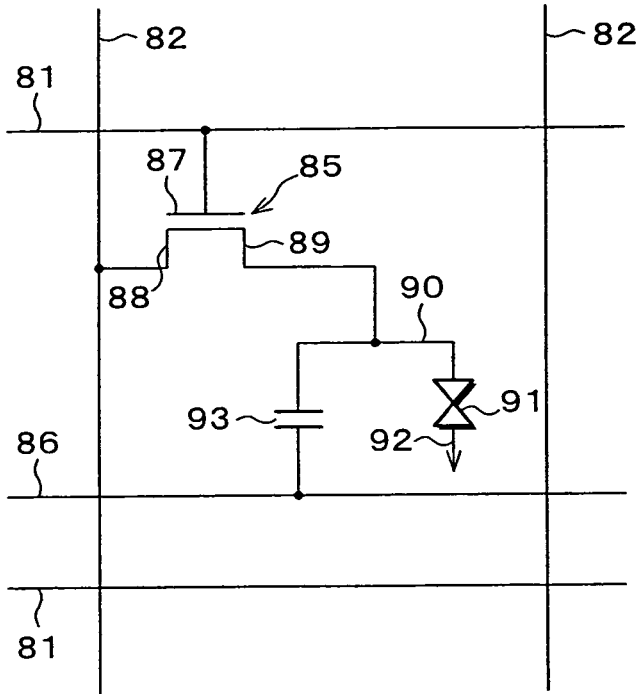
FIG. 10 (PRIOR ART)
FIG. 10 is an equivalent circuit diagram showing one pixel of the liquid crystal display device.
Figure 11:
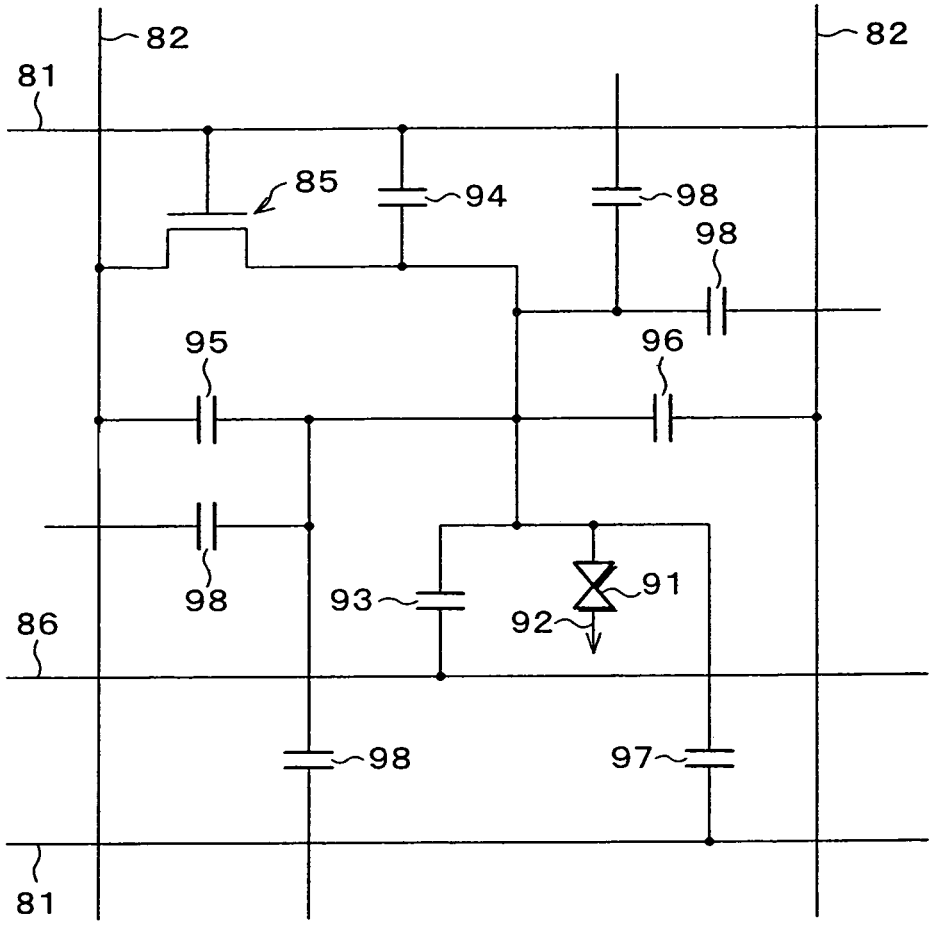
FIG. 11 (PRIOR ART)
FIG. 11 is an equivalent circuit diagram showing parasitic capacitance that occurs between (a) a pixel electrode and (b) each signal wire and each scanning wire in one pixel of the liquid crystal display device, and showing parasitic capacitance that occurs between the pixel electrodes adjacent to each other.

That is, as shown in FIG. 8, each of the source drivers 22 includes a signal wire driving circuit 4 therein, and as shown in FIG. 7, each of the source drivers 22 includes the spare wire driving output buffers 23 in a symmetrical manner. This enables the source driver 22 to be shared in liquid crystal panels 19 that are different from each other in a wiring form of the spare wire due to the difference of a screen size, the number of the pixels, and the like.

In the present embodiment, the spare wire 20 is connected to the spare wire driving output buffer 23 on the right side of the source driver 22. When the wires are disposed in this manner, the spare wire driving output buffer 23 remains unused on the left side of each source driver 22. Thus, it is possible to connect the dummy signal wire S0 to the spare wire driving output buffer 23 on the left side of the leftmost source driver 22, and it is possible to use the leftmost spare wire driving output buffer 23 also as the dummy pixel driving output buffer 18*a*.

That is, in the gate line inversion driving mode, the dummy signal wire S0 connects a wire branched from the signal wire S3 to the spare wire driving output buffer 23 in the leftmost source driver 22 as shown in FIG. 8. Further, an output side of the spare wire driving output buffer 23 is connected to the dummy signal wire S0. Thus, it is possible to drive the dummy signal wire S0 via the spare wire driving output buffer 23 in accordance with the same signal as in the signal wire S3. That is, by using the remaining spare wire driving output buffer 23, it is not necessary to newly provide the dummy pixel driving output buffer 18*a*, so that it is possible to avoid problems such as increase in cost caused by increase in a chip area.

Further, although FIG. 8 shows an example of the gate line inversion driving mode, it is possible to use the dummy signal wire S0 as the same wiring form as in the case of the dot inversion driving mode or the source inversion driving mode in the present embodiment like the aforementioned Embodiment 1.

Note that, the description is given on the case of the leftmost signal wire S1 in Embodiments 1 and 2. The arrangement is not necessarily limited to this, but a similar arrangement is possible by using the rightmost signal wire. Other than this, the present invention is applicable by varying the wiring form.

As described above, in the liquid crystal display device of the present embodiment, the spare wire buffer 23 is used also as the dummy wire driving output buffer 18*a*'. Thus, it is possible to clear the problems such as coloring that occurs in a certain pixel on the endmost signal wire S1, so that it is possible to improve the display quality of the liquid crystal panel 19. Further, the spare wire driving output buffer 23 is used also as the dummy pixel driving output buffer 18*a*', so that it is not necessary to newly provide the buffer circuit. Thus, it is possible to avoid the increase in cost caused by the increase in the chip area.

Note that, although the description is given on the effect brought about by the combination of the dummy pixel 30*a* and the dummy signal wire S0 in the present embodiment, the arrangement is not necessarily limited to this, and it is possible to obtain the same effect even in a case where only the dummy signal wire S0 is provided.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A liquid crystal display device comprising:

a plurality of pixels disposed in a matrix manner;

scanning wires to which scanning signals are applied;

signal wires to which data signals are applied, the signal wires crossing the scanning wires in such a manner that each of intersections of the scanning wires and the signal wires corresponds to each of the plurality of pixels;

switching elements, electrically connected to the scanning wires and the signal wires, each of the switching elements being provided in a vicinity of each of the intersections of the scanning wires and the signal wires;

pixel electrodes connected to the switching elements;

a dummy pixel, provided externally adjacent to an endmost pixel column, that is connected to a dummy signal wire;

wherein the dummy pixel and the dummy signal wire are provided outside leftmost pixels;

a source driver for supplying the data signals to the signal wires;

a spare wire driving output buffer, provided on the source driver in advance, that connects a spare wire for restoring one of the signal wires that has been disconnected; and wherein the spare wire driving output buffer is used also as a dummy pixel driving output buffer.

* * * * *